US005837337A

United States Patent [19]

Schnitzer

[11] Patent Number: 5,837,337

[45] Date of Patent: Nov. 17, 1998

[54] BUSINESS FORM WITH INTEGRATED LAMINATION

[75] Inventor: David H. Schnitzer, Buffalo Grove, Ill.

[73] Assignee: The Standard Register Company, Dayton, Ohio

[21] Appl. No.: 660,818

[22] Filed: Jun. 10, 1996

[51] Int. Cl.[6] ..... G09F 3/10

[52] U.S. Cl. ..... 428/40.1; 281/2; 281/5; 283/81; 428/41.9; 428/42.1; 428/42.2; 428/42.3; 428/43; 428/202; 428/203; 462/2

[58] Field of Search ..... 428/40.1, 42.3, 428/42.2, 42.1, 41.9, 202, 203, 43; 283/81; 281/2, 5; 462/2

[56] References Cited

U.S. PATENT DOCUMENTS

| | | | |
|---|---|---|---|
| 5,230,938 | 7/1993 | Hess | 428/42.3 |
| 5,279,875 | 1/1994 | Juszak | 428/42.3 |
| 5,518,787 | 5/1996 | Konkol | 428/202 |
| 5,637,369 | 6/1997 | Stewart | 428/42.3 |

*Primary Examiner*—Nasser Ahmad

*Attorney, Agent, or Firm*—Killworth, Gottman, Hagan & Schaeff, L.L.P.

[57] ABSTRACT

A protectible form including a base ply having a printable face and a release face, a clear ply secured to the base ply release face by an adhesive, and a boundary cut defining matching selected portions of the base ply and the clear ply, whereby the clear ply selected portion may be removed from the base ply release face and adhered to the base ply printable face in a printing protecting position over substantially all of the base ply selected portion. A method of forming a protected individualized card is also shown, including the steps of (1) providing a base ply with first and second faces, with the first face being adapted for receiving printing and the second face having at least a portion with adhesive release material, (2) releasably securing a clear ply to the base ply portion with an adhesive, (3) cutting the base ply and the clear ply to define matching overlying card portions in the base ply and the clear ply, (4) printing information on the first face of the base ply card portion, and (5) removing the clear ply card portion from the base ply second face and adhering the clear ply card portion to the base ply card portion first face.

38 Claims, 3 Drawing Sheets

BUSINESS FORM WITH INTEGRATED LAMINATION

BACKGROUND OF THE INVENTION

1. Technical Field

The present invention is directed toward protecting printed information, and more particularly toward protecting cards having individualized printed information thereon.

2. Background Art

Business forms are in many cases important documents which will be handled extensively and therefore are subject to being tattered or otherwise worn, frayed, soiled or damaged so that the printing thereon might be made unreadable. For example, certificates or the like which are intended to be used over a period of time might be damaged in such a manner. Identification badges are a particularly common form of this, as they might be used only a relatively short period of time but handled in a manner which would be highly susceptible to damaging. Membership cards are another common form of this, which cards might be handled somewhat less frequently but over a longer period of time.

A typical manner of protecting such documents is to subject them to a lamination process which secures a protective lamination over the form. This can be effective, but has significant drawbacks. First, it is difficult to accomplish in cases where there are a large number of such forms to be laminated. Further, since the protective lamination must overly the form and printed material to be protected, it invariably requires that the process be done after printing of the form. Since variable information (such as the names on each identification badge) is usually printed on the forms by the form user rather than the form manufacturer, the separate process is typically required to be done by either the printer of the variable information or the recipient of the form (since lamination prior to printing would inhibit the ability to print and any printing on the lamination would obviously not be protected by the lamination).

However, it is cost prohibitive for the printer to individually laminate numerous copies of the form. This is particularly so when the portion requiring lamination is only a part of a larger form, such as a membership card incorporated with a dues statement or the like. While the lamination process might conceivably be simplified by separately handling the part to be laminated from other parts (for example, by separately making a dues statement and related membership card), to do so would incur significant other handling costs (requiring that each statement and card be separately handled and placed in an separate envelope, a significant task when the statements and cards are individualized and therefore must be matched together).

In order to minimize this burden of lamination, the form printers have frequently placed the lamination burden on the end recipients of the forms. In such cases, they have often supplied the end recipient with a separate sheet of an adhesive-backed clear ply which the recipient is supposed to apply to the proper portion of the form. However, in even these cases, there are still handling costs (the form and a clear ply for use to laminate the form must both be supplied in an envelope), they still necessitate the use of separate and costly envelopes to hold all of the pieces (thereby preventing use of mailers in which the form itself comprises the envelope), they generate waste material (besides the extra required envelope, the release sheet backing protecting the adhesive on the back of the clear ply must be removed and then discarded), and the end user may fail to recognize and use the clear ply to protect the form (he may not notice it in the envelope, or may lose it, or may not recognize the purpose of the clear ply).

The present invention is directed toward overcoming one or more of the problems set forth above.

SUMMARY OF THE INVENTION

In one aspect of the present invention, a protectible form is provided, including a base ply having a printable face and a release face, a clear ply secured to the base ply release face by an adhesive, and a boundary cut defining matching selected portions of the base ply and the clear ply, whereby the clear ply selected portion may be removed from the base ply release face and adhered to the base ply printable face in a printing protecting position over substantially all of the base ply selected portion.

In preferred forms of this aspect of the present invention, the printable and release faces may be on the same or opposite sides of the base ply, the base ply selected portion is a card printable with personalized information on the base ply printable face; the boundary cut is in a shape which is substantially symmetrical about a line; the boundary cut in the clear ply is a die cut; and the base ply is 8–10 mil paper stock and the clear ply is 1–2 mil film.

In one preferred form of this aspect of the present invention, the base ply is a business form and the boundary cut in the base ply is a perforation with ties releasably retaining the base ply selected portion with the remainder of the form. In an alternative form of this aspect of the present invention, the boundary cut in the base ply is a die cut defining a discrete form bound by the die cut.

In another aspect of the present invention, a method of forming a protected individualized card is provided, including the steps of (1) providing a base ply with first and second faces, with the first face being adapted for receiving printing and the second face having at least a portion with adhesive release material, (2) releasably securing a clear ply to the base ply release portion with an adhesive, (3) cutting the base ply and the clear ply to define matching overlying card portions in the base ply and the clear ply, (4) printing information on the first face of the base ply card portion, and (5) removing the clear ply card portion from the base ply second face and adhering the clear ply card portion to the base ply card portion first face.

It is an object of the present invention to provide business forms which can be printed with variable information which will be protected so as to be readable over a long period of time.

It is another object of the present invention to provide a business form which can be extensively handled over a long period of time without becoming tattered, worn, frayed, soiled or damaged.

It is still another object of the present invention to provide business forms which may be easily and inexpensively processed and handled for use with large numbers of individualized recipients.

It is yet another object of the present invention to provide a business form which minimizes costly waste associated with use of the form.

Another object of the present invention is to provide a business form which facilitates proper use of the form by the form recipient.

DESCRIPTION OF THE PREFERRED EMBODIMENT

Figure 1:
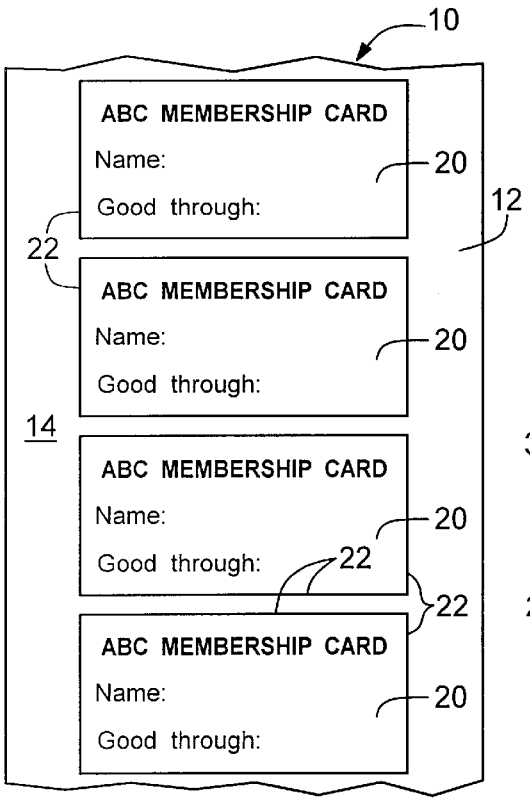
FIG. 1 is a front view of a first embodiment of the present invention.
Figure 2:
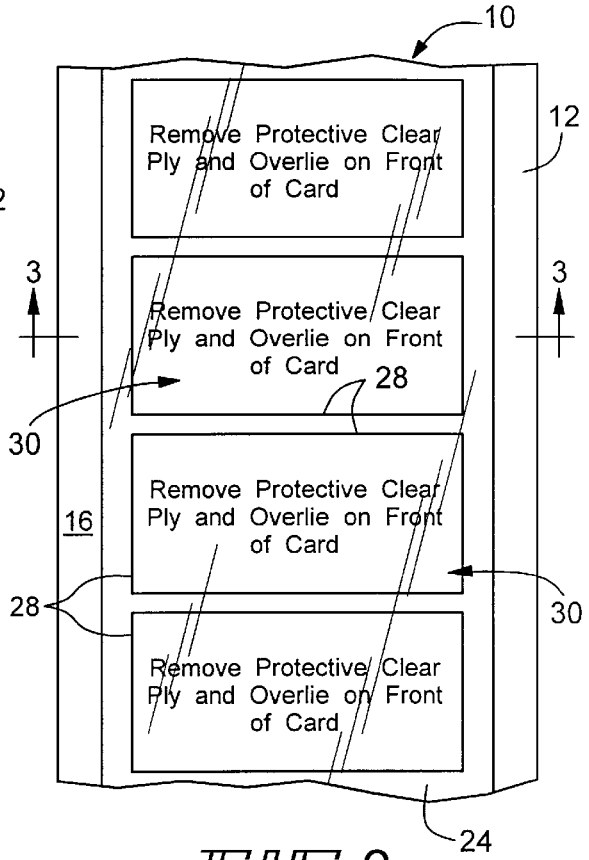
FIG. 2 is a rear view of the FIG. 1 embodiment.
Figure 3:
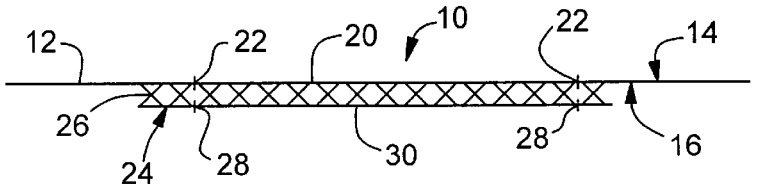
FIG. 3 is a cross sectional view taken along line 3—3 of FIG. 2.

A continuous business form 10 embodying the present invention is shown in FIGS. 1–3. The form 10 includes a base ply 12, preferably a 4–10 mil paper release liner adapted to receive printing on the front face 14 and having a release material on the rear face 16 (as described in greater detail below). However, it should be understood that the base ply 12 could also be made of different thicknesses and different types of material depending upon the application as explained further below.

The continuous form 10 includes discrete card portions 20, preferably defined by cutting perforations 22 in the base ply 12 about the card portion boundaries. Depending on the base ply 12 and intended use, the perforations 22 may have many or few ties connecting the card portions 20 to the rest of the base ply 12. As will be apparent, the perforation 22 is intended to facilitate removal of the card portion 20 from the form 10 after final individualized printing.

The continuous form 10 is preferably first printed with generic information common to all of the card portions 20, such as shown in FIG. 1. After manufacture, the form 10 may be used by the business which sends out the card portions 20, with such user then running the form 10 through their printer to add individual information to the card portions 20 (such as the member'name and the valid date of the membership card in the example shown in FIG. 1). Though not shown, control punch margins or tractor feed holes can also be provided on one or both sides of the form 10 to facilitate feeding of the form 10 during the manufacturing process and/or during final individualized printing by the business user.

As illustrated in FIGS. 2–3, a continuous clear ply 24 is secured to the rear face 16 of the base ply 12 by a suitable pressure sensitive adhesive 26 (see FIG. 3). Preferably, the clear ply 24 is a 1–2 mil clear film face stock which is transparent such that any printing on the base ply 12 when beneath the clear ply 24 may be readily read. The particular thickness and material of the clear ply 24 could be different, however, depending on the requirements of the particular application and the thickness of the base ply 12 (so long as the clear ply 24 remains substantially transparent). For example, a card formed from a one mil clear ply and an eight mil base ply would have substantially the same thickness as a card formed from a five mil clear ply and a four mil base ply.

The release material on the rear face 16 of the base ply 12 is at least in the areas corresponding to the card portions 20. As is generally known in the art, suitable release material should be sufficient to adhere to the pressure sensitive adhesive 26 to secure the clear ply 24 thereto, but will adhere to the adhesive 26 less well than is the clear ply 24 such that when the clear ply 24 is removed from the rear face 16 of the base ply 12, the adhesive 26 will go with the clear ply 24.

The clear ply 24 also includes die cuts 28 defining clear ply card portions 30 which match and overlie the base ply card portions 20. Preferably, the matching card portions 20, 30 are symmetrical about a central line (for example, a line down the middle of the form 10 in the FIG. 1–3 embodiment) so that the clear ply card portion 30 may be taken from the rear face and applied to the front face 14 of the base ply card portion 20, in which case the shape of the clear ply card portion 30 will still match the shape of the base ply card portion 20 to provide substantially complete coverage and protection without any part of the clear ply card portion 30 extending beyond the boundary of the base ply card portion 20. Since no part of the clear ply card portion 30 extends beyond the boundary of the base ply card portion 20 when it is applied thereto, it will be understood that the clear ply card portion 30 is no greater in size than the base ply card portion 20). A rectangular shape such as shown in FIGS. 1–2 will accomplish this, but it should be recognized that a wide variety of different shapes could also be used (for example, radius corners are commonly provided with cards).

With the base ply card portions 20 defined by perforations 22, the clear ply card portions 30 will be carried with the form 10 by the adhesive 26. However, it should be understood that the clear ply 24 could alternatively be cut with a perforation, in which case the card portion 20 of the base ply 12 could be die cut completely around its boundary without any ties. Alternatively, both card portions 20, 30 could be defined by perforations. Generally, however, it is preferred to die cut 28 the clear ply 24 as ties of its material generally have a greater tendency to stretch when pulled free, rather than cleanly tearing.

It should now be understood that the front face 14 of the base ply 12 can be printed with variable information and the card portions 20, 30 then individually removed from the form 10 (either by the end user or by the business user prior to giving the card portions to the appropriate end users), and the end users may then peel the clear ply card portion 30 from the rear face 16 of the base ply card portion 20 and then reapply the clear ply card portion 30 to the front face 14 of the base ply card portion 20, where the clear ply card portion 30 will function to protect the printing on the base ply front face 14.

This structure may thus be used to extend the useful life of the card, as well as providing an attractive card over a longer period of time (thereby allowing the group to avoid the negative connotations which might be derived by people who observe a shabby appearing membership card). Further, the clear ply card portion 30 will prevent the printing on the base ply front face 14 from being fraudulently changed (in some cases, the business user may wish to apply the clear ply card portion 30 before sending it to the end user to prevent fraud by the end user).

In all cases, these advantages are accomplished without requiring handling of a separate laminate or piece, which might get lost or overlooked. In this regard, the instructions for protecting the card could be printed on the base ply rear face 14 (such as illustrated in FIG. 2) or elsewhere on the portion of the form 10 given to the end user so that the card portion is essentially self contained. Therefore, even if the end user recipient does not initially recognize that the clear ply card portion 30 is to be applied to the front face 14 of the base ply card portion 20, the clear ply card portion 30 will remain with the card to provide some additional stiffness and protection and, moreover, at some later point in time when the end user does recognize the directions on the rear face 16, he will still have the protective clear ply card portion 30 which he can then readily use.

In an alternative form, the clear ply card portion may be provided adjacent to, but not overlying, the base ply card portion. In this alternative form, the clear ply may be adhered to either side of the base ply, and in fact may be adhered to the front of the base ply next to the portion where information is to be printed. With this alternative form, the end user would be given at least those portions of the form which include the base ply card portion and clear ply card portion. In such case, the instructions could be printed anywhere on the portion given to the end user.

Figure 4:
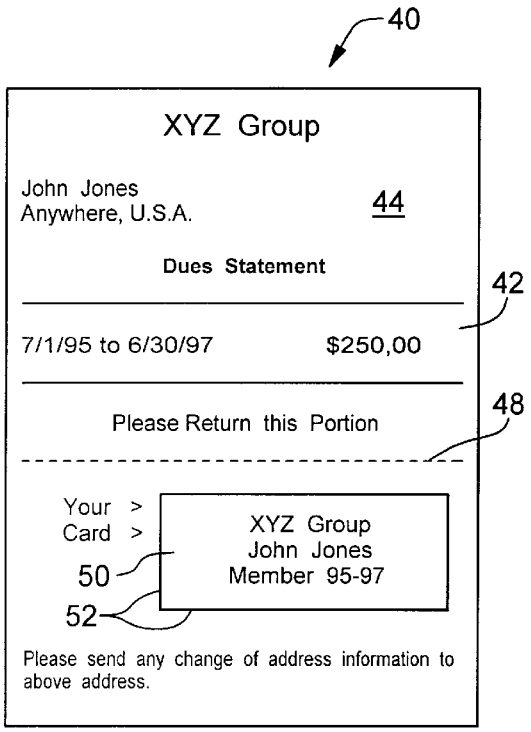
FIG. 4 is a front view of a second embodiment of the present invention.
Figure 5:
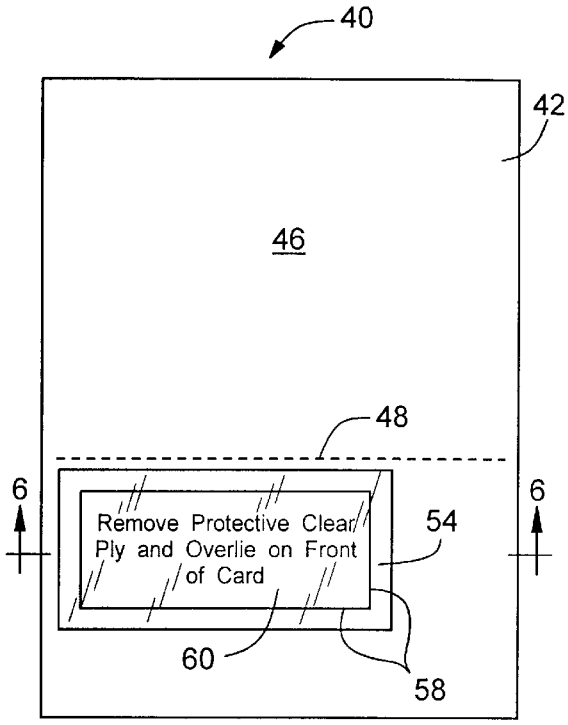
FIG. 5 is a rear view of the FIG. 4 embodiment.
Figure 6:
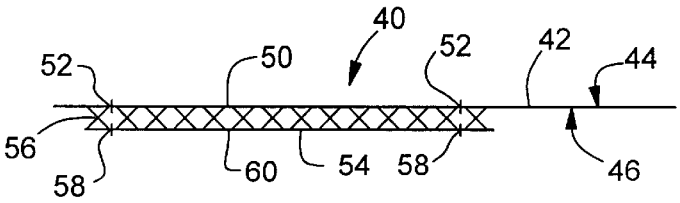
FIG. 6 is a cross sectional view taken along line 6—6 of FIG. 5.

A second embodiment using the present invention is shown in FIGS. 4–6. In this embodiment, the business form 40 is a cut sheet in which the card is incorporated within a larger form 40 intended to be used for more than just creating the protected cards.

With this second embodiment, the form 40 is typically first manufactured with a continuous web or ply and then later transversely cut to separate sheets, for printing thereafter by laser printers or the like with a sheet feeder. Alternatively, the forms could be continuous with transverse perforations therebetween, with the perforations burst after individualized printing by the business user to similarly end up with separate sheets. (Of course, it should also be understood that the first embodiment could also be cut into separate sheets or could be provided in a continuous form with transverse perforations between separate sections).

Similar to the first embodiment, the form 40 includes a base ply 42 adapted to receive printing on the front face 44 and having a release material on a portion of the rear face 46.

The form 40 includes may include a number of different portions (for example, a returnable billing statement separated from the remainder of the form by a perforation 48), as well as an integral card portion 50, preferably defined by cutting a perforation 52 in the base ply 42 about the card portion boundary. The form 40 as illustrated in FIG. 4 has already been finally printed by the business user, with individualized information thereon (including the member'name [twice] and address and date and dues information).

As illustrated in FIG. 5, a section of clear ply 54 is secured to the rear face 46 of the base ply 42 by a suitable pressure sensitive adhesive 56 (see FIG. 6) on the rear face 46 of the base ply card portion 50. The rear face 46 of the base ply 42 has a suitable release material at least in the area corresponding to its card portion 50. Application of the clear ply 54 may be accomplished in any suitable manner including, for example, cutting sections off a continuous clear ply having adhesive applied to one side (or by applying adhesive to appropriate portions of the base ply), and tipping those sections onto the appropriate portions of a continuous base ply during manufacture, as is generally known in this art.

The clear ply 54 also includes die cuts 58 defining clear ply card portions 60 which match and overlie the base ply card portions 50. However, as noted in connection with the first embodiment, it should be understood that the clear ply 54 could alternatively be cut with a perforation, in which case the card portion 50 of the base ply 42 could be die cut completely around its boundary without any ties or, alternatively, both card portions 50, 60 could be defined by perforations. As also previously indicated, the matching card portions 20, 30 are preferably symmetrical about a central line (for example, a line down the middle of the card portions 50, 60) so that the clear ply card portion 60 may be appropriately removed from the rear face and applied to the front face 44 of the base ply card portion 50 to provide substantially complete coverage and protection of the base ply card portion 50 without any part of the clear ply card portion 60 extending beyond the boundary of the base ply card portion 50. Since no part of the clear ply card portion 60 extends beyond the boundary of the base ply card portion 50 when it is applied thereto, it will be understood that the clear ply card portion 60 is no greater in size than the base ply card portion 50).

This embodiment will thus also provide the many advantages of the present invention. The business user may print individualized information on cards which might be integrally desired for use with other business documentation, and such cards can thereafter be easily protected against degradation from handling, as well as protecting against fraudulent changes to the card. All this is quickly and easily accomplished, without requiring handling of separate parts, thereby eliminating such costly handling as well as eliminating the risk that such separate parts might be lost or inadvertently discarded. Still further, particularly in the disclosed embodiments in which the card portions overlie each other, this is accomplished with a form in which there is minimal waste, as the backing portion which would be discarded with separate laminates as in the prior art is eliminated with these embodiments.

It should also be readily understood that the present invention can be used with a wide variety of different business forms. As yet another example, it should be recognized that a card according to the present invention could be integrated into a mailer structure, such as a tri-folded ply, so that any need for a separate envelope to hold different components (such as the separate laminate sheet as used in the previously discussed prior art) may be eliminated, thereby eliminating the cost and waste involved with such an envelope as well as the costly stuffing of such envelopes.

Figure 7:
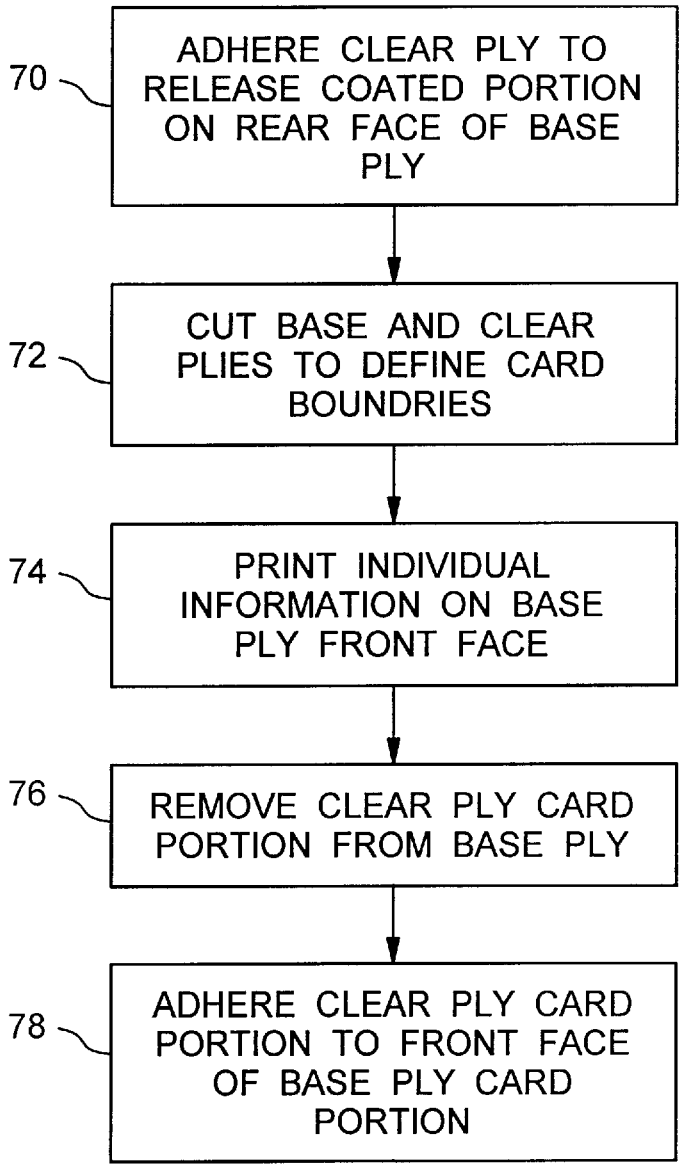
FIG. 7 is a flow chart showing the method of making and using the present invention.

FIG. 7 illustrates the preferred method of making and using the present invention.

During the initial manufacturing process, a clear ply is suitably adhered to a release coated portion on the rear face of the base ply (step 70). As previously noted, this may be done in a variety of ways depending on the desired final form, including applying a continuous clear ply to a continuous base ply, or applying sections of clear ply to a continuous base ply.

The base plies and clear plies are suitably cut to define overlapping card portions in both plies (step 72). Such cuts may be a complete die cut in one of the plies, though preferably at least one of the cuts is a perforation with ties retaining the card portions to the remainder of the form until separation of the card portion is desired. However, it should be understood that it would be within the scope of the present invention to completely die cut through both plies where subsequent handling of the card would not be expected to require integration of the card with a larger form (for example, when the separate cards could be adequately handled during subsequent individualized printing of the cards, as could readily occur if subsequent printing were to be done by hand as might occur if the end user were required to sign his card).

At this point, the card may be printed with individual information on the front face of the base ply (step 74). As already noted, such printing can be done by various types of printers or even by hand.

Once the base ply front face has been printed with all of the desired information, the clear ply card portion may then be removed from the rear face of the base ply card portion (step 76). The clear ply card portion, together with the adhesive stuck thereon after release from the release coated rear face of the base ply card portion, is then adhered to the base ply front face (step 78), thereby providing protection against damage, whether intentional or merely through wear and tear, and against any subsequent alteration of the card and the printing thereon.

Still other aspects, objects, and advantages of the present invention can be obtained from a study of the specification, the drawings, and the appended claims.

I claim:

1. A protectible form, comprising:

a base ply having a printable face and a release face;

a clear ply secured to said base ply release face by an adhesive, said clear ply having a greater adherence to said adhesive than said base ply release face such that said adhesive will remain with said clear ply upon separation of said clear ply from said base ply; and a boundary cut defining matching and aligned selected portions of said base ply and said clear ply, such that said clear ply selected portion is removed from said base ply release face and adhered to the base ply printable face in a printing protecting position over substantially all of the base ply selected portion with said clear ply selected portion being substantially the same size as said base ply selected portion.

2. The form of claim 1, wherein said base ply printable face and said base ply release face are on opposite sides of said base ply.

3. The form of claim 1, wherein said base ply printable face and said base ply release face are on the same side of said base ply, and said boundary cut comprises a perforation about said base ply selected portion and a die cut about said clear ply selected portion.

4. The form of claim 1, wherein said boundary cut is in a shape which is substantially symmetrical about a line.

5. The form of claim 1, wherein said boundary cut in said clear ply is a die cut.

6. The form of claim 1, wherein said boundary cut in said base ply is a perforation with ties releasably retaining the base ply selected portion to the remainder of the base ply, and said boundary cut in said clear ply is a die cut substantially aligned with said base ply boundary cut.

7. The form of claim 1, wherein said boundary cut is a single die cut through both said base ply and said clear ply to define a discrete form bound by said die cut.

8. The form of claim 1, wherein said base ply and clear ply are continuous, and said boundary cut defines transverse lines separating adjacent selected portions.

9. The form of claim 8, wherein said boundary cut further defines lines between said transverse lines and spaced from the faces of the continuous base ply to define selected portions narrower than the base ply.

10. The form of claim 1, wherein said base ply comprises a business form, and said boundary cut in said base ply is a perforation with ties releasably retaining the base ply selected portion with the remainder of the form.

11. The form of claim 1, wherein said selected portion comprises a card printable with personalized information on said base ply printable face.

12. The form of claim 1, wherein said base ply is 8–10 mil paper stock, and said clear ply is 1–2 mil film.

13. A protectible card, comprising:

a base ply having a printable face and a release face;

a clear ply secured to at least a portion of said base ply release face by an adhesive, said clear ply having a greater adherence to said adhesive than said base ply release face such that said adhesive will remain with said clear ply upon separation of said clear ply from said base ply; and a boundary cut defining matching and aligned card-shaped portions of said base ply and said clear ply with said clear ply card-shaped portion being substantially the same size as said base ply card-shaped portion, such that said clear ply portion is removed from said base ply release face and adhered to the base ply printable face in a printing protecting position over substantially all of any printing on the base ply portion.

14. The form of claim 13, wherein said base ply printable face and said base ply release face are on opposite sides of said base ply.

15. The card of claim 14, wherein said boundary cut is a single die cut through both said base ply and said clear ply to define a separate card bound by said die cut.

16. The form of claim 13, wherein said base ply printable face and said base ply release face are on the same side of said base ply, and said boundary cut comprises a perforation about said base ply card-shaped portion and a die cut about said clear ply card-shaped portion.

17. The card of claim 13, wherein said boundary cut is substantially rectangular.

18. The card of claim 13, wherein said boundary cut in said clear ply is a die cut.

19. The card of claim 13, wherein said boundary cut in said base ply is a perforation with ties releasably retaining the base portion to the remainder of the base ply, and said boundary cut in said clear ply is a die cut substantially aligned with said base ply boundary cut.

20. The card of claim 13, wherein said base ply and clear ply are continuous, and said boundary cut defines transverse lines separating adjacent portions.

21. The card of claim 20, wherein said boundary cut further defines lines between said transverse lines and spaced from the faces of the continuous base ply to define said portions narrower than the base ply.

22. The card of claim 13, wherein said base ply comprises a business card, and said boundary cut in said base ply is a perforation with ties releasably retaining the base ply portion with the remainder of the card.

23. The card of claim 13, wherein said base ply portion comprises a card printable with personalized information on said base ply printable side.

24. The card of claim 13, wherein said base ply is 8–10 mil paper stock, and said clear ply is 1–2 mil film.

25. A business form including a protectible separable card, comprising:

a base ply having a printable face and a release face, said release face including at least a portion with a release material thereon;

a clear ply secured to said base ply release face portion by adhesive, said clear ply having a greater adherence to said adhesive than said base ply release face portion such that said adhesive will remain with said clear ply upon separation of said clear ply from said base ply; and a boundary cut defining matching and aligned sections of said base ply and said clear ply, said clear ply section being substantially the same as said base ply section, such that said clear ply section is removed from said base ply release face and adhered to the base ply printable face in a printing protecting position over substantially all of the base ply section.

26. The form of claim 25, wherein said base ply printable face and said base ply release face are on opposite sides of said base ply.

27. The card of claim 26, wherein said boundary cut is a single die cut through both said base ply and said clear ply to define a discrete card bound by said die cut.

28. The form of claim 25, wherein said base ply printable face and said base ply release face are on opposite sides of said base ply, and said boundary cut comprises a perforation about said base ply matching section substantially aligned with a die cut about said clear ply matching section.

29. The form of claim 25, wherein said boundary cut is substantially rectangular.

30. The form of claim 25, wherein said boundary cut in said clear ply is a die cut.

31. The form of claim 25, wherein said boundary cut in said base ply is a perforation with ties releasably retaining the base ply section to the remainder of the base ply.

32. The form of claim 25, wherein said cut matching sections are narrower than said base ply.

33. The form of claim 25, wherein said base ply is 8–10 mil paper stock, and said clear ply is 1–2 mil film.

34. A protectible form, comprising:

a base ply having a printable face on a front side and a release face on a rear side;

a clear ply secured to said base ply release face by an adhesive, said clear ply having a greater adherence to said adhesive than said base ply release face such that said adhesive will remain with said clear ply upon separation of said clear ply from said base ply;

a die cut defining a selected portion of either said base ply or said clear ply, and a perforation defining a selected portion of the other of said base ply and said clear ply, said perforation including ties releasably retaining the perforation defined selected portion with the remainder of the associated ply;

wherein said selected portions are aligned such that said portions overlie one another and are substantially symmetrical about a line with the selected portion of the clear ply being substantially the same size as the selected portion of the base ply, and said clear ply selected portion is removed from said base ply release face and adhered to the base ply printable face in a printing protecting position over substantially all of the base ply selected portion without any part of the clear ply extending beyond any edge of the selected portion of the base ply.

35. The form of claim 34, wherein said die cut defines the clear ply selected portion and the perforation defines the base ply selected portion.

36. The form of claim 34, wherein said base ply selected portion comprises a card printable with personalized information on said base ply printable face.

37. The form of claim 34, wherein said base ply is 8–10 mil paper stock, and said clear ply is 1–2 mil film.

38. The form of claim 34, wherein said selected portions when adhered together are at least 10 mil thick.

* * * * *